US005435015A

United States Patent [19]

Ellis-Brewer

[11] Patent Number: 5,435,015

[45] Date of Patent: Jul. 25, 1995

[54] PANTY FOR PROTECTING UPPER PUBIC AREA

[76] Inventor: Evelyn M. Ellis-Brewer, 4964 Berkeland Ct., San Jose, Calif. 95111

[21] Appl. No.: 264,992

[22] Filed: Jun. 23, 1994

[51] Int. Cl.[6] ..... A41B 9/00

[52] U.S. Cl. ..... 2/406; 2/400; 2/407; 2/403

[58] Field of Search ..... 2/67, 73, 400, 401, 2/402, 403, 404, 405, 406, 407, 408, 409, 227, 79, 243.1; 11/73; 450/115, 116, 117

[56] References Cited

U.S. PATENT DOCUMENTS

| | | | |
|---|---|---|---|
| 2,058,970 | 10/1936 | Flesh | 2/403 X |
| 2,078,184 | 4/1937 | Russell | 2/403 X |
| 2,385,995 | 10/1945 | Kneibler | 450/104 X |
| 2,651,777 | 9/1953 | Fox | 2/406 |
| 2,854,006 | 9/1958 | Giemer | 450/117 |
| 3,034,136 | 5/1962 | Halperin | 2/409 |
| 3,322,120 | 5/1967 | Wyss et al. | 2/401 X |
| 3,441,022 | 4/1969 | Severson et al. | 2/403 X |
| 3,517,666 | 6/1970 | Atlee | 2/403 X |
| 4,351,340 | 9/1982 | McLeod | 2/406 X |
| 4,883,481 | 11/1989 | Blanchard | 2/406 |
| 5,093,935 | 3/1992 | Countee, Jr. | 2/400 |
| 5,217,447 | 6/1993 | Gagon | 2/400 |
| 5,291,617 | 3/1994 | Moretz et al. | 2/400 |

*Primary Examiner*—Jeanette E. Chapman
*Attorney, Agent, or Firm*—Keith Kline

[57] ABSTRACT

An undergarment for people who have an overhanging upper abdomen, a fat apron, which when wearing ordinary undergarments would rub against the lower abdomen. The undergarment includes a pouch in the upper abdomen area to contain the fat apron, thereby eliminating any skin-to-skin rubbing. The pouch is formed by adding a panel to the ordinary construction of the undergarment. The pouch and crotch of the garment is lined to absorb perspiration and increase comfort for the user. The leg openings can be made adjustable in size by including fasteners on the leg. The fasteners can be of any easily adjusted construction, such as typical hook-and-eye fasteners like Velcro.

5 Claims, 3 Drawing Sheets

PANTY FOR PROTECTING UPPER PUBIC AREA

FIELD OF THE INVENTION

The present invention relates generally to undergarments, and more particularly to an undergarment with a pouch to contain excess flesh from the user's abdomen.

BACKGROUND OF THE INVENTION

Patents pertaining to undergarments have addressed many varied issues. Many are directed to the comfort and/or safety of the user, and many address problems related to the weight or body type of the user.

A typical undergarment in the prior art directed to the comfort of the user is a device that provides additional padding for a sitting user, the "PADDED UNDERWEAR" of Alphonse A. Guelli, U.S. Pat. No. 4,969,216, issued Nov. 13, 1990. This device allows a user with hemorrhoids comfort when sitting, and may also be used as a sports protection device. A garment that similarly provides additional, strategically placed, padding for the user is disclosed in the "MATERNITY SIT-EASE PANTIES" of Shafer, et al., U.S. Pat. No. 4,382,443, issued May 10, 1983.

A more commonplace problem is that of overweight people dealing with bulging or sagging abdominal flesh. The "PANTY HOSE WITH BODY BULGE CONTROL" is typical of the garments designed to suppress the bulging of the abdomen, thighs, or buttocks of the user.

The most serious problem with such restrictive devices is that they are of course limited by the binding force of the garment, and can only contain a small amount of excess flesh. Another shortcoming of restrictive devices is that they can be very uncomfortable for the user.

One problem not addressed by any of the prior art garments is that of the person whose excess flesh exceeds the limits of a restrictive garment. This person is faced with the uncomfortable situation of having an apron of abdominal flesh from the abdomen overlap the flesh of the upper pubic region. This situation is common in people that have either a great excess of abdominal flesh, and/or have had their abdominal muscles weakened by pregnancy, giving birth, or by injury.

A typical panty worn by a person with the apron of fat described above will stretch in the leg opening area, so that extra material is moved to cover the apron. This causes the leg opening to expand, which in turn allows some of the wearer;'s excess tissue to protrude through the leg opening. This situation is very uncomfortable.

Problems caused by the apron of fat for an individual include the irritation that can be caused by the skin-to-skin contact, which can lead to rashes and infections. The fat apron can also cause a person to perspire heavily, which is uncomfortable and can lead to an unpleasant odor.

OBJECTS, SUMMARY, AND ADVANTAGES OF THE INVENTION

Accordingly, it is an object of the present invention to provide an undergarment that eliminates the skin-to-skin contact that occurs when a person has an overhanging abdomen, a fat apron, that rubs against the skin of the upper pubic region.

It is a further object of the present invention to provide an undergarment which has a pouch to enclose the fat apron.

In summary, the present invention is an undergarment for people who have an overhanging upper abdomen, a fat apron, which when wearing ordinary undergarments would rub against the upper pubic region.

The undergarment of the present invention includes a pouch in the upper abdomen to contain the fat apron, thereby eliminating any skin-to-skin rubbing. The pouch is formed by adding a panel to the ordinary construction of the undergarment.

The pouch and crotch of the garment are lined to absorb perspiration and increase comfort for the user.

The leg openings can be made adjustable in size by including fasteners on the leg. The fasteners can be of any easily adjusted construction, such as typical hook-and-eye fasteners like Velcro.

An advantage of the present invention is that the comfort of the user is greatly increased due to the elimination of the skin-to-skin contact.

A further advantage of the present invention is that it provides health advantages due to the reduction of the potential for rashes and infections.

Another advantage of the present invention is that it is adjustable to many sizes.

These and other objects and advantages of the present invention will become apparent to those skilled in the art in view of the description of the best presently known mode of carrying out the invention as described herein and as illustrated in the drawings.

BEST MODE OF CARRYING OUT THE INVENTION

Figure 1:
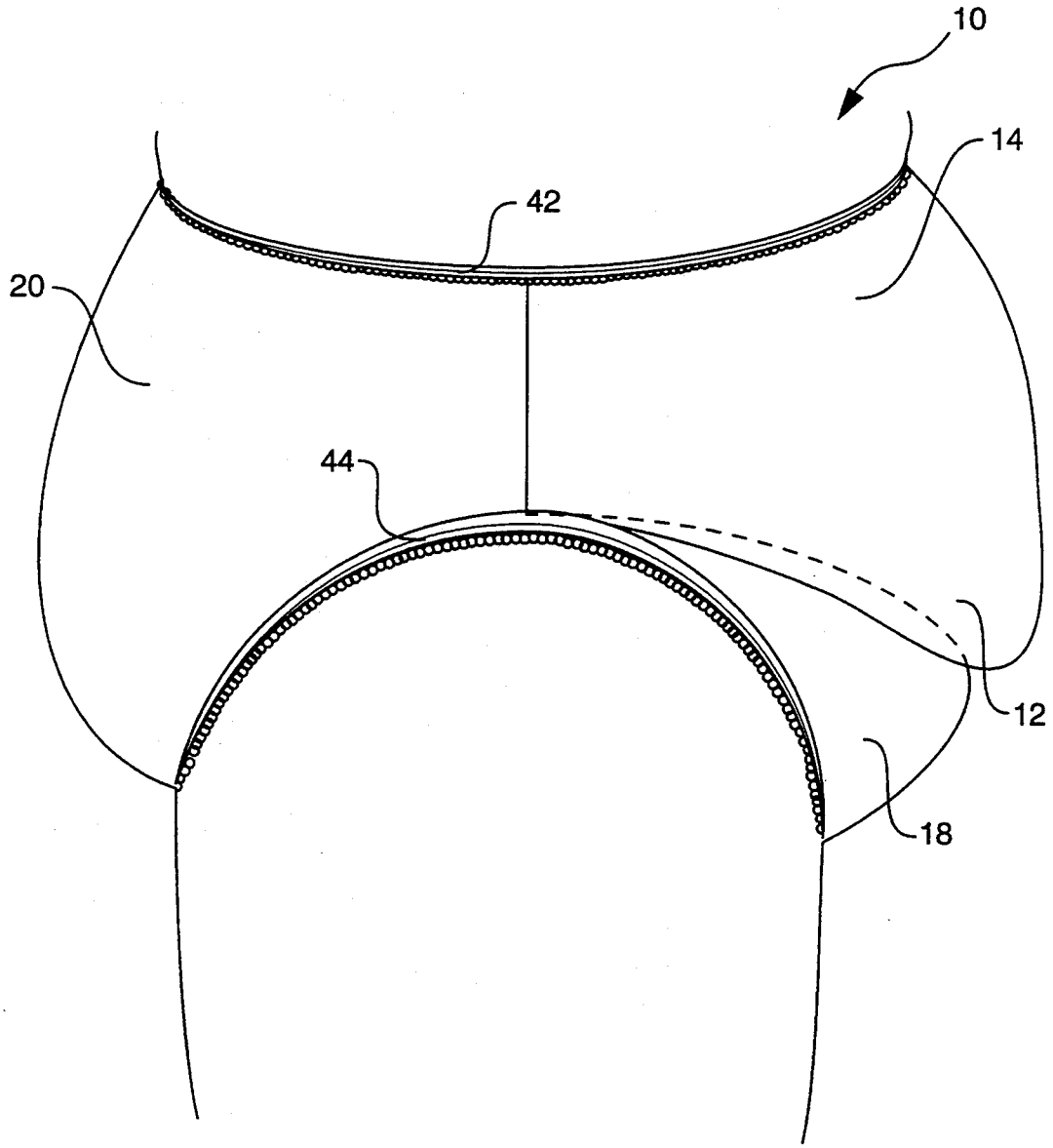
FIG. 1 is a side perspective view of the undergarment on a user.

Referring first to FIG. 1, the present invention is an undergarment or panty 10. The panty 10 includes a pouch 12 to contain an overhanging upper abdomen, or fat apron. The pouch 12 has an absorbent liner to absorb the perspiration of a user.

Figure 2:
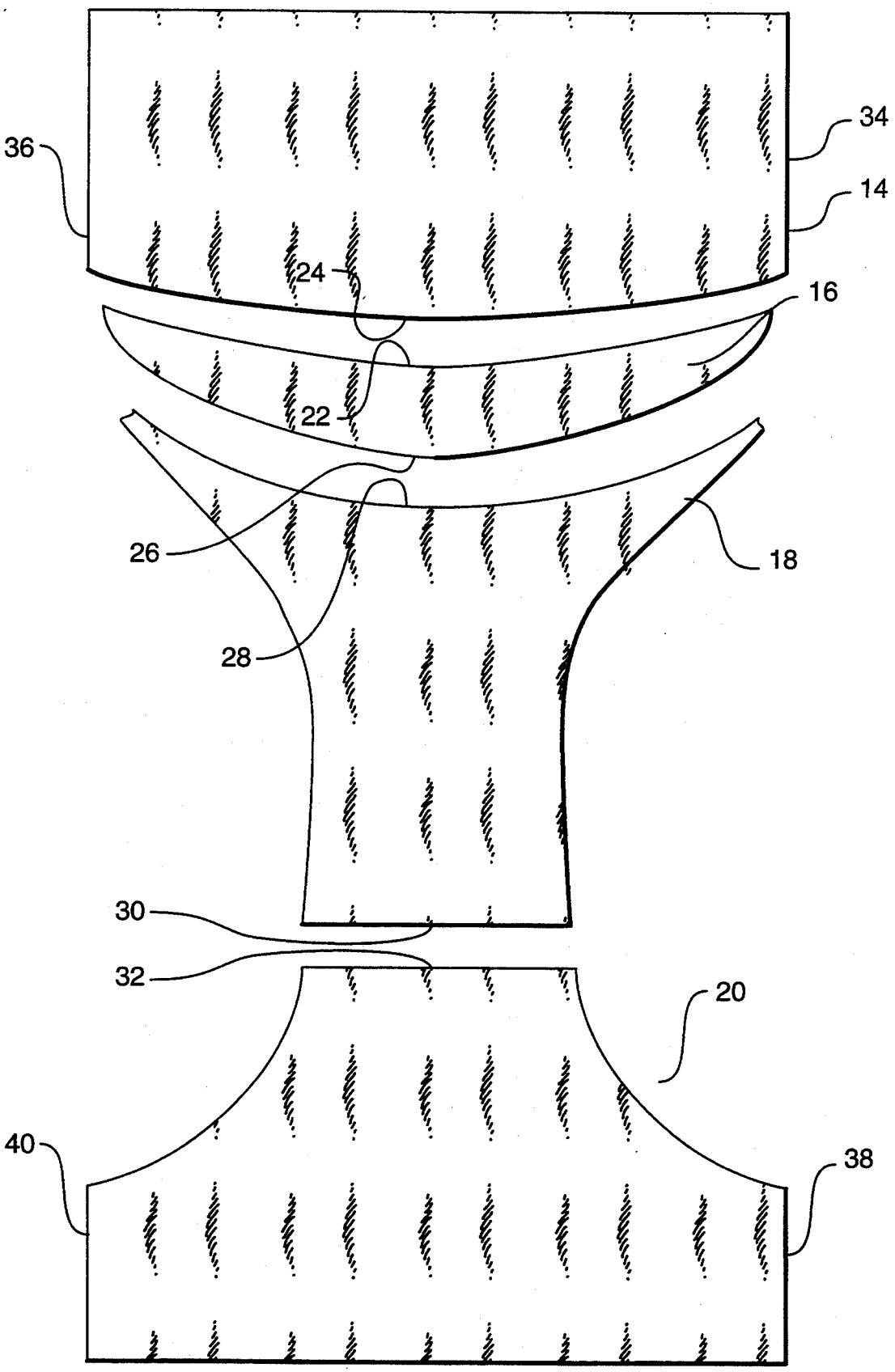
FIG. 2 is a layout of the components of the undergarment before assembly.

Construction of the panty 12 is most easily understood with reference to FIG. 2. The panty 12 comprises four panels: a front panel 14, a pouch panel 16, a crotch panel 18, and a back panel 20. Most of these components are used in the prior art in some form, but the pouch panel 16 is an addition to the standard components used for a panty. The pouch panel 16 forms the rear of the pouch 12.

Assembly of the panty 12 is begun by sewing a front edge 22 of the pouch panel 16 to a lower edge 24 of the front panel 14. The front edge 22 of the pouch panel 16 is approximately four inches narrower than the lower edge 24 of the front panel 14.

To achieve the proper orientation of the pouch panel 16, gathers must be taken in the seam between the front panel 14 and the pouch panel 16. These two components, the front panel 14 and pouch panel 16, together form the pouch 12 which contains the user's fat apron. The pouch panel 16 becomes the rear wall of the pouch 12.

Next, a rear edge 26 of the pouch panel 16 is sewn to a front edge 28 of the crotch panel 18. The rear edge 26 of the pouch panel 16 is approximately eight inches wider than the front edge 28 of the crotch panel 18. Gathers must also be taken in this seam, but not as much as in the seam between the front edge 22 of the pouch panel 16 and the lower edge 24 of the front panel 14.

A rear edge 30 of the crotch panel 18 is then sewn to a lower edge 32 of the back panel 20, joining all the components of the panty 10.

Finally, side seams are formed by joining respectively left 34 and right 36 side edges of the front panel 14 to left 38 and right 40 side edges of the back panel 20.

A waistband 42 and leg opening bands 44 may then be added to finish the product.

Departures from the industry norm for certain of the components of the panty 10 should be noted: the front panel 14 is longer from top to bottom so that the user's abdomen is covered, and the waistband 42 stays in its proper location, as opposed to sliding down away form the wearer's proper waist area. The crotch panel 18 has also been lengthened to provide a better fit around the legs. The crotch panel 18 has been designed to curve up under the abdomen to provide the first layer of protection against skin-to-skin contact.

Figure 3:
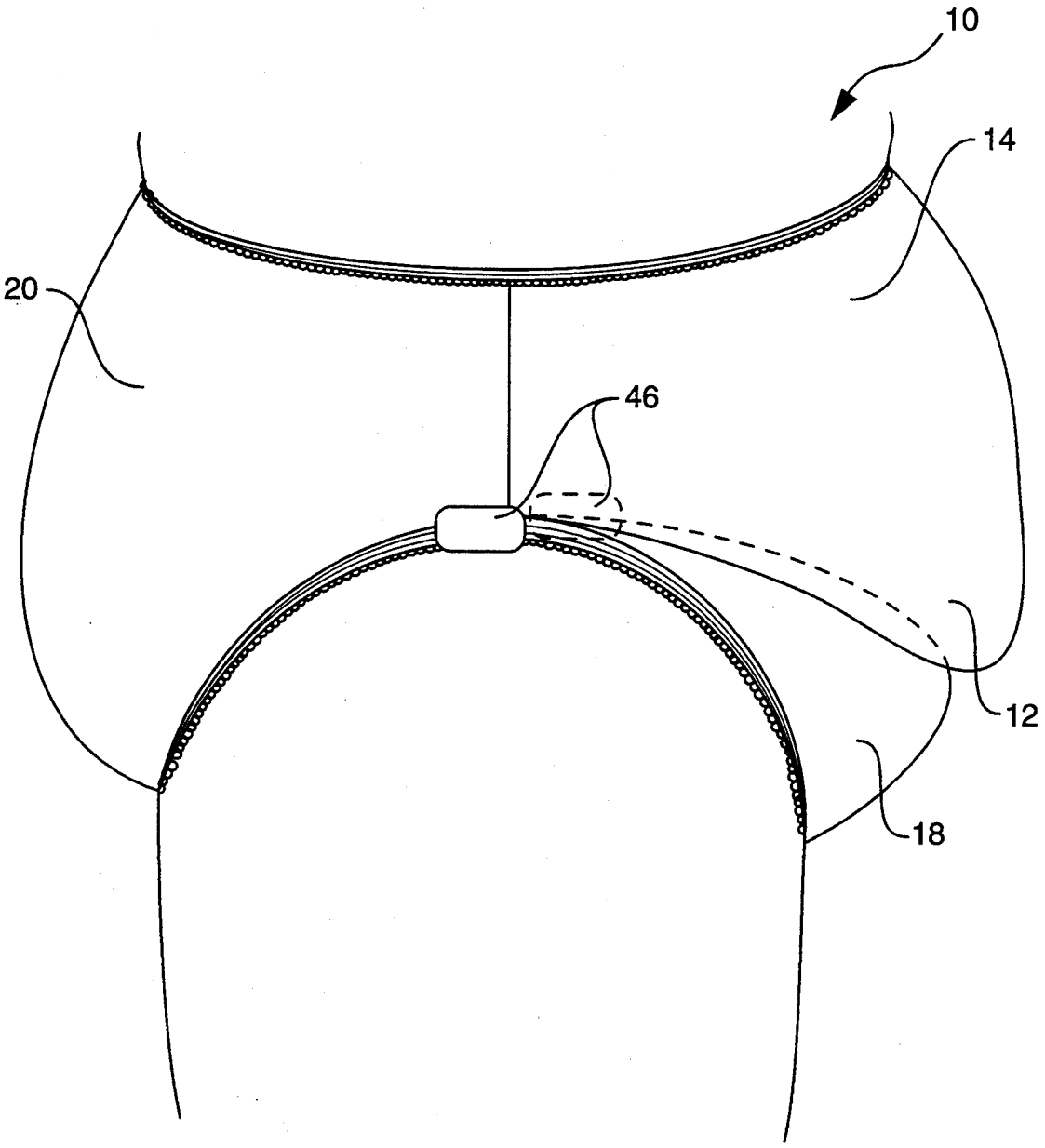
FIG. 3 is a side perspective view of the undergarment with an adjustable leg opening.

An additional option for the panty 10 is illustrated in FIG. 3. An adjustable fastener 46 is added at the leg opening band 44. This enables the user to adjust the size of the leg opening to ensure proper fit.

Materials used for the panty 10 of the present invention are cotton, open mesh/cotton, stretch tricots or any other fabric desired by the user. The only critical material choice is that the pouch panel 16 and the crotch panel 18 must be lined with an absorbent fabric.

It should be noted that at least two alternate usages of the present invention are envisioned: with leg segments to form pantyhose, and with provisions to be used as garments to protect against incontinence.

The above disclosure is not intended as limiting. Those skilled in the art will readily observe that numerous modifications and alterations of the device may be made while retaining the teachings of the invention. Accordingly, the above disclosure should be construed as limited only by the metes and bounds of the appended claims.

I claim:

1. An undergarment comprising:

a front panel, a pouch panel, a crotch panel, and a back panel; wherein a front edge of the pouch panel is sewn to a lower edge of the front panel, the seam formed therebetween including gathers, a rear edge of the pouch panel is sewn to a front edge of the crotch panel,the seam formed between the pouch panel and the crotch panel also including gathers, but to a lesser degree than the seam between the pouch panel and the front panel, a rear edge of the crotch panel is sewn to a lower edge of the back panel, thereby joining together all major components of the undergarment, and with side seams formed by joining respectively left and right side edges of the front panel to left and right side edges of the back panel;

the front panel and pouch panel together forming a pouch to contain a user's overhanging upper abdomen therein, thus eliminating skin-to-skin contact of the abdomen and upper pubic region, and wherein the pouch panel and the crotch panel are lined with an absorbent material.

2. The undergarment of claim 1 wherein:

leg openings and a seam between the pouch and a front panel of the undergarment each include an adjustable fastener, thereby allowing the user to adjust the size of the leg openings and the pouch.

3. The undergarment of claim 1 wherein:

the front panel is longer, as compared to industry standards, from top to bottom so that the user's abdomen is completely covered, thereby allowing a waistband to stay in its proper position by eliminating the tendency of the waistband to be pulled below the wearer's abdomen.

4. The undergarment of claim 1 wherein:

the crotch panel is longer, as compared to industry standards, from front to back to provide a better fit around the user's legs, the crotch panel further curving up under the user's abdomen to provide a first layer of protection against skin-to-skin contact.

5. The undergarment of claim 1 wherein:

leg segments are connected to the panty to form pantyhose.

* * * * *